US008226318B1

(12) United States Patent
Williams

(10) Patent No.: US 8,226,318 B1
(45) Date of Patent: Jul. 24, 2012

(54) TUBE WITH INTEGRAL ELASTOMERIC APPLICATOR AND METHOD OF MANUFACTURE THEREFOR

(76) Inventor: Douglas Williams, White Plains, NY (US)

( * ) Notice: Subject to any disclaimer, the term of this patent is extended or adjusted under 35 U.S.C. 154(b) by 1462 days.

(21) Appl. No.: 11/752,429

(22) Filed: May 23, 2007

Related U.S. Application Data

(60) Provisional application No. 60/803,643, filed on Jun. 1, 2006.

(51) Int. Cl.
*B05C 11/00* (2006.01)
*B43M 11/06* (2006.01)

(52) U.S. Cl. ..... 401/266; 401/265; 401/183; 401/262

(58) Field of Classification Search ..... 401/261–266, 401/183–186
See application file for complete search history.

(56) References Cited

U.S. PATENT DOCUMENTS

| | | | | |
|---|---|---|---|---|
| 4,211,501 | A * | 7/1980 | Pedroso et al. | 401/261 |
| 4,844,250 | A * | 7/1989 | Holoubek et al. | 222/107 |
| 6,572,300 | B2 * | 6/2003 | Altonen et al. | 401/266 |
| 6,739,781 | B2 * | 5/2004 | Maloney et al. | 401/266 |
| 7,108,442 | B2 * | 9/2006 | DuFour | 401/263 |
| 7,309,184 | B2 * | 12/2007 | Butcher et al. | 401/172 |

* cited by examiner

*Primary Examiner* — David Walczak
(74) *Attorney, Agent, or Firm* — Steven M. Hoffberg; Ostrolenk Faber LLP

(57) ABSTRACT

A cosmetic dispenser, comprising: an integral thermoplastic container body, comprising an integral wall, a molded thermoplastic neck, adapted for engaging a cap, and an inner support extending therefrom; and an overmolded thermoplastic elastomer applicator, adhered outside the inner support, wherein an aperture communicates from the container body, through the neck and inner support, and through the elastomeric applicator. The neck and inner support are preferably formed by compression molding a tube, or by injection molding integral with the body.

17 Claims, 3 Drawing Sheets

TUBE WITH INTEGRAL ELASTOMERIC APPLICATOR AND METHOD OF MANUFACTURE THEREFOR

FIELD OF THE INVENTION

The present invention relates to integral composite material applicator tips for cosmetic, ointment and lotion containers, and methods of manufacture therefore.

BACKGROUND OF THE INVENTION

Liquid makeup and other viscous cosmetics are often stored in specialized cosmetics containers. In certain containers, the applicator can be affixed to the container body itself, whereby, for example, the user squeezes the container to force makeup out of the reservoir and directly into or onto the applicator.

In the case where the applicator is connected as a separate element to the container body, it is not uncommon for leakage to occur at or near the location where the makeup passes from the storage reservoir into the applicator. This leakage can occur either during use of the device, when the cap has been removed from the container, or when the device is not in use and the cap is affixed to the container. When the cap is affixed to the container, leaking makeup can accumulate under the cap, such that once the cap is removed from the container, the accumulated makeup will spill out. If the applicator is separate from the container body, there is also risk of separation.

Various types of cosmetics containers have been proposed to prevent or reduce this unintended and undesirable leakage. Certain of these containers utilized both a cap and a sealing mechanism, for example, a stopper, to prevent leakage. The sealing mechanism was designed to prevent potential leakage, and any makeup that did leak past the sealing mechanism was subsequently caught in the cap. However, a user had to perform multiple steps in order to access the makeup in these containers. For example, the user had to first remove the cap, and then disengage the stopper in order to initiate flow of makeup from the device. Multiple steps were also needed to close and store the container, in that the user had to first engage the stopper, and then place the cap on the container in order to provide maximum leakage protection when the device was not in use. Further, the sealing mechanisms were not effective to prevent leakage at the unsealed junction between the storage reservoir and the applicator, and the sealing mechanisms were often easily removable from the container (intended or unintended), which increased the likelihood of leakage.

Prior techniques for forming an elastomer applicator tip employ a co-molded elastomer and stiff support applicator tip, which is then inserted into a compression molded head of an extruded tube. This technique is time consuming and costly, and results in an unsealed junction.

See, U.S. Patent Application Ser. Nos. 60/515,680, 11/040,279, 60/570,783 (EP1595470), and 60/427,697 (WO2004/048218, U.S. Pat. Pub 2006/0137999 "[0017]A reservoir can be made by various processes, including the use of an extruded material and by injection molding. For example, a reservoir material can be formed into a cylinder (e.g., by extrusion), and sealed at one end (e.g., by heating and crimping) to form a tubular reservoir. Such a reservoir tube can be spin-welded, ultrasonic welded, or otherwise bonded to a neck, preferably before sealing. In another method, a neck/reservoir combination can be injection molded as a single piece. Preferably, when the container is injection molded, the wall thickness will be greater than when extruded components are used. Polypropylene and HDPE are preferred for injection-molded reservoirs, and all three classes of materials (polypropylene, HDPE, and co-extruded polyethylene and EVOH) are preferred for extruded reservoirs."), expressly incorporated herein by reference.

In a co-injection molding process, a first resin is injected, and tends to form a skin against the relatively colder mold. The second resin is then injected, and fills the space within the first resin, allowing a different material on the surface than on the interior of the mold. This process is advantageous, for example, where a different color is sought at the surface, or where a higher quality material is used at the surface than in the interior. Typically, the interior material includes a portion of recycled material.

2K molding provides a flash-free, co-molded part that may eliminate the time and expense involved in additional product handling, tooling and assembly while ensuring high-quality components. In the 2K injection molding process, two molding compounds are injected into a single mold. A key factor in 2K molding is the adhesion between the different materials used. 2K molding is also known as Overmolding or insert molding, has been used with Thermoplastic Elastomers (TPEs), to result in products which have both a soft feel at the surface and strength and rigidity underneath. Rigid substrates include polypropylene (PP), polyethylene (PE), amorphous polar plastics such as polycarbonate (PC), polymethylmethacrylate (PMMA), polystyrene (PS), high impact polystyrene (HIPS), polyphenylene oxide (PPO), glycol modified polyethylene terephthalate (PETG), Acrylonitrile Butadiene Styrene (ABS), semi-crystalline polar plastics such as polyester (PET, PBT) and Polyamide (Nylon 6, Nylon 66). Many factors are very important for overmolding TPEs onto rigid substrates. The selection of the type of TPE in combination of the rigid substrate material is the first and foremost. Also important are machine type, process conditions, material preparation, part design and mold design.

Two-component injection molding has gained popularity because of its fast process time and versatility of combining a wide variety of materials. The two-component injection molding, also referred to as two-shot molding, consists of a machine with two independent injection units, each of which shoots a different material in series. The first material is injected through the primary runner system while the mold volume to be occupied by the second material is shut off from the primary runner system. The mold is then opened and the core plate is rotated and the second material is injected from the secondary runner system.

A more economical approach is insert molding. It has a lower output than two-shot molding. In insert molding, a pre-molded rigid plastic substrate or metal part is inserted into the cavity via robotics or an operator. The second (overmold) material is either injected onto one side of the insert or sometimes completely surrounds the insert. Insert molding can be done using conventional injection molding equipment. The Overmold elastomer is usually a thin skin molded on top of the engineering substrate. Thermoplastic Elasotmers are based on hard and soft segments. These segments can either be built in the molecular architecture or created in the morphology. The hard segment determines the chemical and heat resistance of the product whereas the soft segment influences the elasticity and softness in the product.

An elastomer is a polymer having elastic properties, i.e., has the ability to readily deform under load and return to its original shape when a load is removed. Elastomers are typically amorphous polymers existing above their glass transition temperature, so that considerable segmental motion is possible. At ambient temperatures rubbers are thus relatively soft (E~3 MPa) and deformable. Their primary uses are for seals, adhesives and molded flexible parts.

Elastomers are usually thermosets (requiring vulcanization) but may also be thermoplastic, i.e., can be remelted and hardened. The long polymer chains cross-link during curing and account for the flexible nature of the material. Example elastomers include Natural Rubber, Polyisoprene, Butyl Rubber (copolymer of isobutylene and isoprene), Polybutadiene, Styrene Butadiene Rubber or SBR (copolymer of polystyrene and polybutadiene), Synprene® (styrenic block copolymer), styrenic Nitrile Rubber (copolymer of polybutadiene and acrylonitrile, also called buna N rubbers), Chloroprene Rubber (polychloroprene, also called Neoprene), Silicone RTV (room temperature vulcanizing), LSR (liquid silicone rubber), FKM Viton®, Tecnoflon® (copolymer of vinylidene fluoride and hexafluoropropylene), Santoprene®, Fluorosilicone Rubber, EPM and EPDM rubber (ethylene propylene rubber, a copolymer of polyethylene and polypropylene), Polyurethane rubber, Resilin, Polyacrylic rubber (ABR), Epichlorohydrin rubber (ECO), Polysulfide Rubber, and Chlorosulfonated Polyethylene (CSM), (Hypalon®), for example. In general, there are classified as Styrenic block copolymers, Olefinic Copolymers, Thermoplastic Vulcanizates, Thermoplastic Urethanes, Copolyesters, and Copolyamides. Each of these chemistries offer different properties and performances related to the overmolding applications.

For the TPE to function in the application, the first and foremost requirement is to have good adhesion to the substrate and simultaneously meet other functional properties. Adhesion between the TPE and the substrate is strongly dependent on the surface energy of the two materials. Since the elastomer forms the outer surface in an overmold part there are certain ergonomic requirements for the elastomer to meet. Softness (lower durometer) is required to give cushioning and give.

Because of the inherent requirement to have good adhesion to the substrates, overmold products can have problems with mold sticking. These products usually have very low melt viscosity, which helps wetting the substrate. This helps with adhesion but increases mold wetting and if the mold is not designed will it can result in flashing. Mold sticking will result in problems with de-molding as well and can also cause the substrate to deform because of undue stresses put on the part.

SUMMARY OF THE INVENTION

The present invention provides a package comprising a sealed tube having a flexible, inelastic wall, with an integral applicator formed of an elastic material. This design allows an elastic applicator integral to the tube to be used for spreading the product as well as massaging the product in to the user's skin.

Typical prior cosmetic dispensing designs provided a molded-in applicator, formed of the same material as the tube. This forces a compromise between material properties suitable for forming a tube, and the feel of the tip In order to prevent ballooning of the tube, a relatively inelastic material is used for tube materials. That is, when the tube is compressed, the pressure is transmitted to a fluid within the tube, which is then expelled through an orifice. If the tube were formed of an elastic material, compressing the tube wall would result in ballooning of the wall material, and thus limiting pressure buildup.

As discussed above, a known design provides a two part applicator and tube in which an overmolded applicator tip having a rigid support and a Thermoplastic Elastomer (TPE), i.e., a thermoplastic shell is inserted into the neck of a tube. This container, however, suffers from an unsealed junction between the tip and tube, and a somewhat more complex manufacturing process than an embodiment of the present invention.

Advantageously, the applicator tip is formed of an elastomer, such as liquid silicone rubber (LSR) or Synprene®, which is soft and flexible. Such elastomeric materials are generally unsuitable for tube forming.

The tube is advantageously formed of Polypropylene (PP), High-Density Polyethylene (HDPE), and Co-extruded PE and ethylene vinyl alcohol (EVOH). PP and HDPE can be injection molded, while PP, HDPE, and Co-Extruded PE and EVOH (Co-Ex) can be extruded to form the tube. The tube material generally has a hard, slippery feel.

The tube preferably has a neck region which forms a cap retaining section, which provides a threaded section or a region with a slightly raised or recessed ring to form a snap seal with a cap. The tube material is typically sufficiently rigid and slick to form the threaded or snapping portion. The neck region also extends to form a rigid support for the TPE at the applicator tip.

The tube blank is formed either as an extruded tube with a compression molded end, or as an injection molded piece.

The package may thus be formed as formed as follows. A tube is extruded from HDPE, and then a cut section of the extruded tube is compression molded to form a threaded neck portion to receive a cap, and an inner rigid support at one end of the tube. The elastomeric resin, such as LSR or Synprene® (styrenic block copolymer) is then injection molded (insert overmolded) over the inner support.

Typically, Synprene® RT-3850, which is available in food grade, is formed by an extrusion process; however, it has been found that by increasing the temperature by about 30 C above the normal die temperature, e.g., 220-265 C, the thermoplastic can be suitably injection molded. Likewise, the relatively high temperatures cause a strong bond to be formed with the HDPE inner support. It is noted that preliminary results suggest that the increased process temperatures to not degrade the Synprene®, and thus should allow it to retain its food rating.

Alternately, the tube body may be injection molded from polyethylene or polypropylene, and the elastomer overmolded.

A further method extrudes the tube body, with the elastomer used as a head which is compression molded onto the tube body.

The design according to a preferred embodiment of the invention is advantageous because the applicator is integral and non-removable from the tube.

Accordingly, the present invention provides a cosmetic dispensing contained having an integral elastomeric applicator and tube. In one embodiment, the container comprises a flexible container body for storing a liquid or viscous material, a relatively rigid neck, an inner support, and an elastomeric applicator formed over the inner support, and a dispensing opening from the container body being formed through the relatively rigid neck and elastomeric applicator. A cap may be provided which is matingly engagable with the neck, for example using a screw top or snap mechanism. The cap preferably seals at both the neck and the dispensing opening with a sealing pin, thus maintaining the liquid or viscous material in the body during storage.

BRIEF DESCRIPTION OF THE DRAWINGS

The various aspects of the invention will now be described by way of example only with reference to the accompanying drawings, in which.

DETAILED DESCRIPTION OF THE PREFERRED EMBODIMENTS

Figure 1:
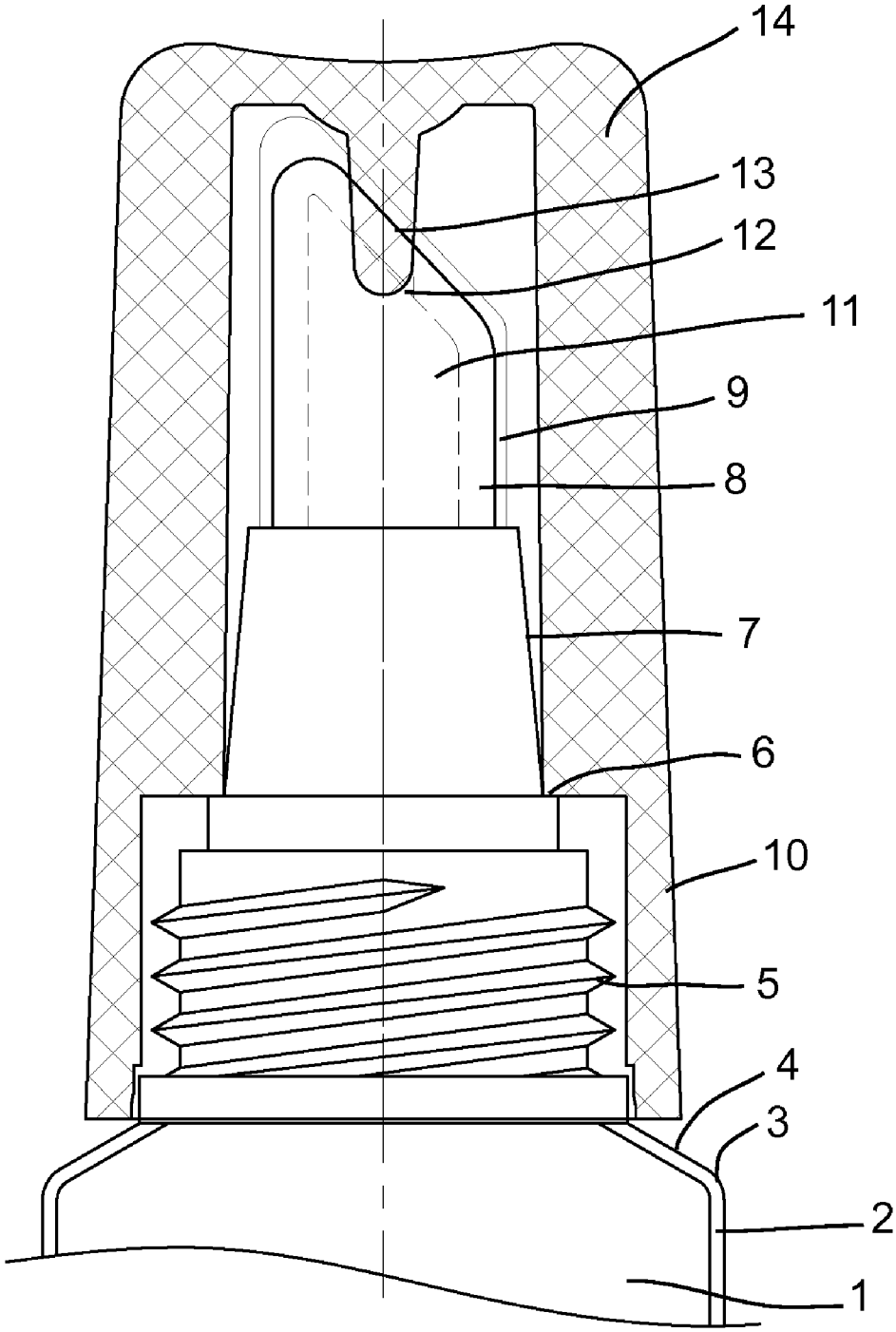
FIG. 1 is a cross-section view of a first embodiment of the invention.

FIG. 1 shows a cross section of a preferred embodiment of the invention. The tube 2 defines a reservoir 1, which is inserted at the rear end (not shown) and the rear end closed. The tube 2 blank, which is, for example, a thermoplastic, is formed in a two step process of extrusion and compression molding, or a single step injection molding process. The tube has a neck 3 which leads to a narrowing portion 4. Neck 3 has a hollow interior communicating with the reservoir, and conventional external screw threads 5 so that a cap 14 with corresponding internal screw threads 10 can be attached. In alternative embodiments, a friction or snap-on fit between cap 14 and neck 3 may be employed.

Figure 3:
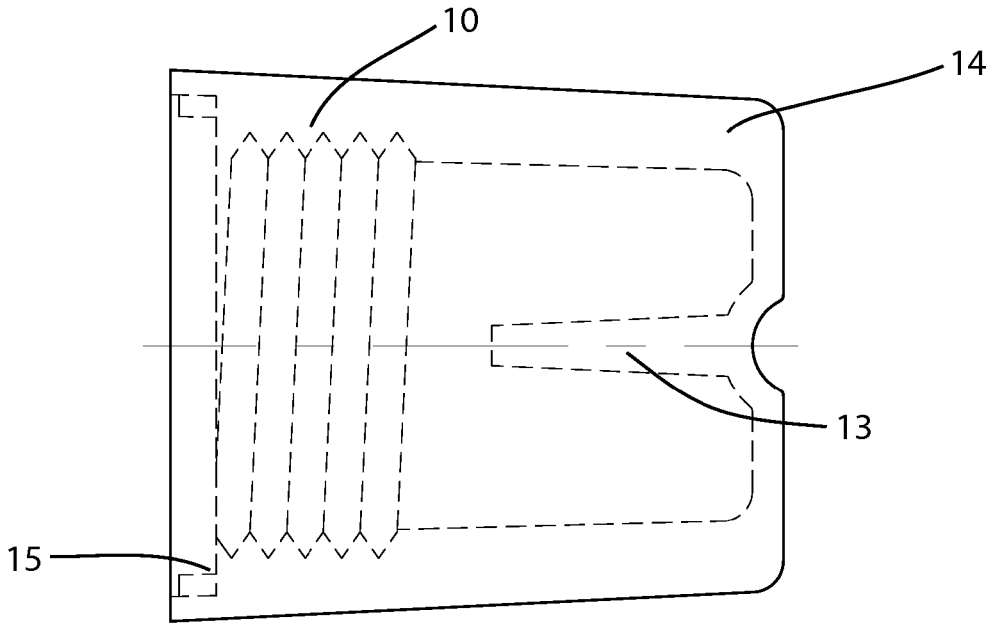
FIG. 3 is side view of a cap according to the second embodiment.
Figure 2:
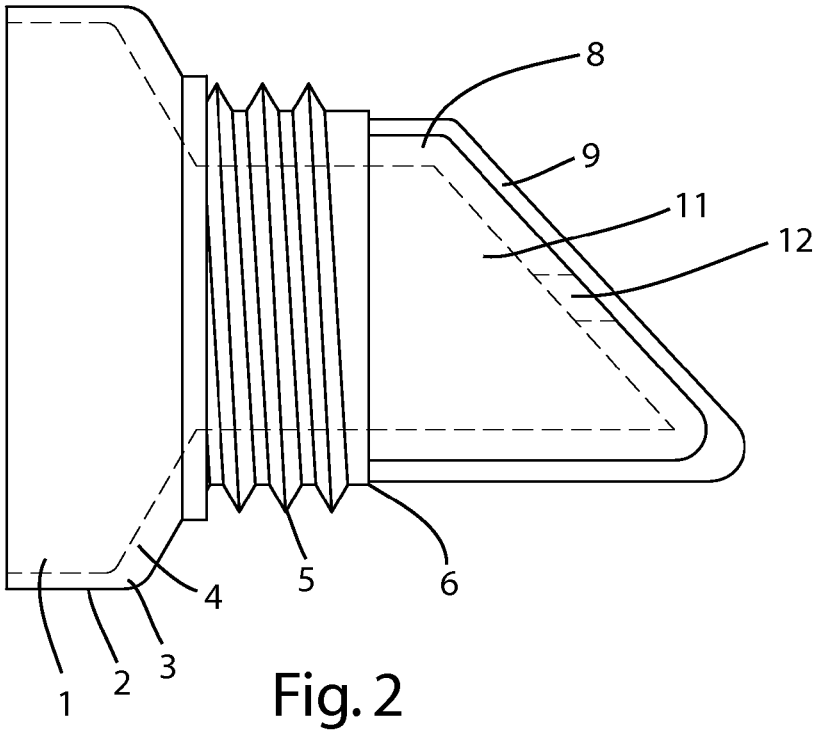
FIG. 2 is a side view of an applicator tip according to a second embodiment of the invention.

Above the external screw threads is a shoulder 6 which meets with surface 15 of the cap 14, which acts as a stop to limit overtightening of the cap 14 on the neck 3. The mating of surface 15 and shoulder 6 also forms a seal. The first embodiment (FIG. 1) and second embodiment (FIGS. 2 and 3) differ principally in that FIG. 1 shows an extended plateau 7 rising above the shoulder 6, which is absent from FIG. 2. The shoulder 6 (FIG. 2) or the extended plateau 7 (FIG. 1), connect to the rigid applicator tip support 8, having internal void space 11, preferably formed of the same material as the tube.

An overmolding process adds a TPE layer 9 over the rigid applicator tip support 8, preferably of Synprene® RT-3850 (Shore A 50), or RT-3805 (Shore A 05).

The cap 14 has, as discussed above, the surface 15, internal screw threads 10, and a sealing pin 13 adapted to insert into the dispensing orifice 12, to seal the tip. The dispensing orifice communicates through the neck 3 to the reservoir 1.

Figure 4:
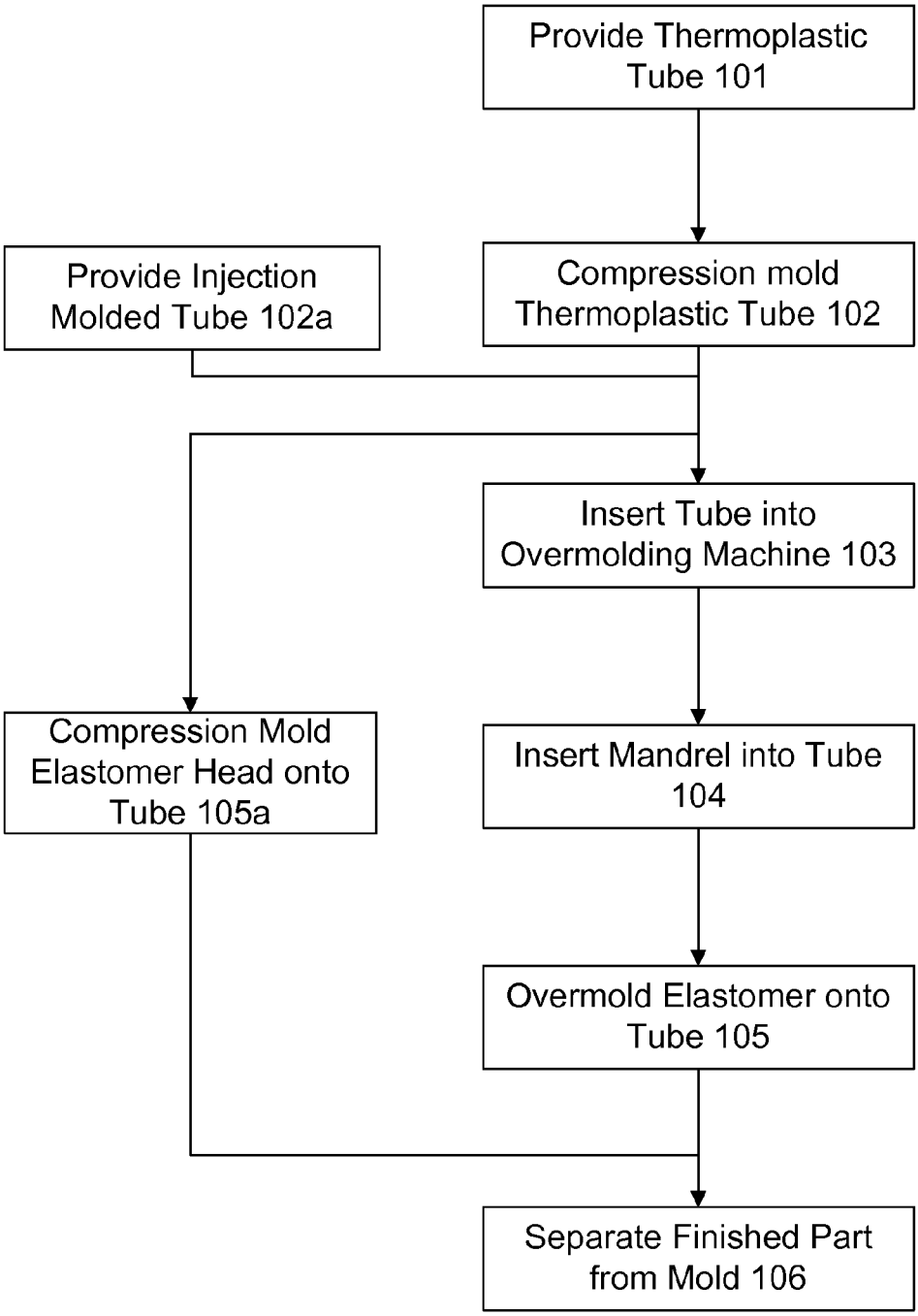
FIG. 4 is a flowchart showing the process according to the present invention.

FIG. 4 shows a flowchart representing the steps of the process. An extruded HDPE tube is provided 101, which may be custom extruded or procured as a standard item. The HDPE tube 2 is then compression molded 102 to form the neck 3, narrowing portion 4, external screw threads 5, shoulder 6, plateau 7, and the rigid applicator tip support 8, which are each hollow and form a direct path to the reservoir 1 formed at the center of the tube 2. (An injection molded container blank may also be provided 102*a*)

The compression molded blank is then inserted into an overmolding machine die 103. An inner mandrel is inserted 104 into the tube blank which supports the rigid compression moded tube structure during overmolding, and has a pin which prevents blockage of the dispensing orifice 12. The overmolding machine then injects 105 a layer of TPE over the rigid applicator tip support 8 only. The finished part is then separated 106 from the mold and the process completed. (The overmolding machine may be replaced with a compression molding machine which fuses an elastomeric head to the container blank 105*a*).

While a robotic system may automate the process, suitable productivity may also be obtained in a largely manual process, and thus robotic systems are not required.

While the invention has been described herein with respect to two embodiments, it should be understood by those that are skilled in the art that it is not so limited. The invention is susceptible of various modifications and changes without departing from the scope of the claims.

What is claimed is:

1. A method for forming a cosmetic dispenser, comprising:

providing a thermoplastic container body having a flexible wall formed from a tubular structure, a neck and inner support at one end of the container body, the neck being adapted for engaging a cap; and overmolding an elastomeric applicator on the inner support, having an aperture communicating from the container body, through the neck and inner support, and through the elastomeric applicator, wherein the flexible wall is configured to be heat sealed to contain a viscous material, and after sealing when squeezed ejects the viscous material from the aperture, substantially without ballooning of the tubular structure, wherein the container body is formed by extruding a thermoplastic tube, and compression molding the neck and inner support at one end of the tube.

2. The method according to claim 1, wherein the container body is formed by injection molding.

3. The method according to claim 1, wherein the thermoplastic comprises high density polyethylene.

4. The method according to claim 1, wherein the thermoplastic comprises polypropylene.

5. The method according to claim 1, wherein the elastomeric applicator comprises a styrenic block copolymer.

6. A method for forming a dispenser, comprising:

providing a tubular hollow thermoplastic container body having a flexible wall, a neck and inner support at one end of the container body, the neck having rigid structures configured to engage a form-fitting cap and having a passage extending through the neck and inner support; and overmolding a soft elastomeric resin to form an applicator on the inner support using an injection molding process, under temperature and pressure conditions which ensure good adhesion and maintain an integrity of the neck and inner support, and substantially without deforming the structures, configured to engage a form-fitting cap, and maintaining an aperture communicating from the container body, through the neck and inner support, and through the elastomeric applicator, wherein the tubular hollow thermoplastic container body is configured to be heat sealed to contain a viscous material, and after heat sealing, when squeezed, ejects the viscous material from the aperture, substantially without ballooning of the tubular structure, wherein the body comprises at least one of polypropylene, high density polyethylene, and co-extruded polyethylene and ethylene vinyl alcohol, the soft elastomeric applicator comprises at least one of liquid silicone rubber and a styrenic block copolymer, and the overmolding is conducted at a temperature of between about 220-265 C.

7. The method according to claim 6, wherein the hollow thermoplastic container body comprises high density polyethylene, and the soft elastimeric resin comprises at least one of Synprene® RT-3850 and Synprene® RT-3805 which is injected molded at a die temperature of between 220-265 C.

8. The method according to claim 6, wherein the soft elastomeric resin is a liquid silicone rubber, which is injected molded over the inner support at a temperature of about 30 C above a nominal die temperature for the respective liquid silicone rubber, and which has a cured shore A hardness of between 5-50.

9. The method according to claim 6, wherein the container body is formed by extruding a thermoplastic tube, and compression molding the neck and inner support at one end of the thermoplastic tube.

10. The method according to claim 6, wherein the container body is formed by extrusion of a tube and compression molding of the neck and inner support on the extruded tube.

11. The method according to claim 10, wherein the elastomeric applicator comprises a styrenic block copolymer.

12. The method according to claim 10, wherein the elastomeric applicator comprises a cured liquid silicone rubber.

13. The method according to claim 12, wherein said overmolding is conducted under such conditions to form strong adhesion between the soft elastomeric resin after curing and the inner support, and low mold wetting to reduce mold sticking.

14. The method according to claim 10, wherein the thermoplastic comprises high density polyethylene.

15. The method according to claim 6, wherein the thermoplastic comprises polypropylene.

16. The method according to claim 6, wherein the soft elastomeric resin comprises a thermosetting polymer injected under pressure surrounding the inner support, and maintained at sufficient temperature to cure the thermosetting polymer and adhere to the inner support substantially without sticking to an injection mold.

17. A method for forming a cosmetic dispenser, comprising:

extruding a thermoplastic tube having a flexible wall;

forming a container body from the thermoplastic tube, the container body having a neck and inner support formed by compression molding at one end of the container body, the neck being adapted for engaging a cap, and an open end at a second end of the container body;

overmolding an elastomeric applicator on the inner support, having an aperture communicating with the reservoir within the container body, through the neck and inner support, and through the elastomeric applicator; and heat sealing the second end of the container body to contain a viscous cosmetic material within the container body, wherein when the flexible wall is squeezed, it pressurizes the viscous material within the reservoir substantially without ballooning the flexible wall, to cause a portion of the viscous material to be ejected from the aperture.

* * * * *